United States Patent [19]

Karaishi

[11] Patent Number: 4,772,527

[45] Date of Patent: Sep. 20, 1988

[54] IMAGE FORMING METHOD USING IMPROVED DEVELOPING AGENT

[75] Inventor: Toshiyuki Karaishi, Tokyo, Japan

[73] Assignee: Kabushiki Kaisha Toshiba, Kawasaki, Japan

[21] Appl. No.: 914,508

[22] Filed: Oct. 2, 1986

Related U.S. Application Data

[63] Continuation of Ser. No. 633,278, Jul. 23, 1984, abandoned.

[30] Foreign Application Priority Data

Jul. 29, 1983 [JP] Japan ..... 58-139897

[51] Int. Cl.[4] ..... G03G 5/08

[52] U.S. Cl. ..... 430/84; 430/85; 430/124; 430/125; 430/126

[58] Field of Search ..... 430/84, 126, 67, 124, 430/125; 118/651

[56] References Cited

U.S. PATENT DOCUMENTS

| | | | |
|---|---|---|---|
| T879,009 | 10/1970 | Staudenmayer et al. | 430/126 |
| 4,241,161 | 12/1980 | Ensing | 430/126 |
| 4,242,434 | 12/1980 | Hirakura et al. | 430/126 |
| 4,368,971 | 1/1983 | Watanabe et al. | 118/651 |
| 4,405,703 | 9/1983 | Onuma et al. | 430/84 |
| 4,654,288 | 3/1987 | Hiro et al. | 430/67 |

OTHER PUBLICATIONS

Mastrangelo Photographic Science & Eng., vol. 26, No. 4, 1982, pp. 194–197.

*Primary Examiner*—John L. Goodrow

*Attorney, Agent, or Firm*—Cushman, Darby & Cushman

[57] ABSTRACT

The present invention uses a developing agent with a Vickers hardness of 3 or more for image forming steps. Therefore, the image forming method according to the present invention can prevent a developing agent from adhering to the surface of an image carrier in a short period of time by the repetition of image forming steps.

21 Claims, 3 Drawing Sheets

IMAGE FORMING METHOD USING IMPROVED DEVELOPING AGENT

This is a continuation of application Ser. No. 633,278, filed July 23, 1984, which was abandoned upon the filing hereof.

BACKGROUND OF THE INVENTION

The present invention relates to an image forming method for developing an electrostatic latent image into a visible image by means of a developing agent and transferring the visible image to a recording medium.

The image forming method of this type is applied to electronic copying machines, facsimiles, electrostatic printing machines and various other apparatuses. This image forming method comprises steps of forming an electrostatic latent image corresponding to an image on the surface of a photosensitive drum including a photoconductive member, electrostatically applying a developing agent of resin or other material to the electrostatic latent image to develop it into a visible image (developing step), transferring the developing agent forming the visible image to a recording medium such as paper (transferring step), fixing the transferred image to the recording medium for image recording (fixing step), and removing the developing agent remaining on the photosensitive drum (cleaning step).

However, after these steps are repeated for thousands of image forming cycles, the developing agent would stick fast to the surface of the photosensitive drum to form black or colored spots thereon, despite the effect of the cleaning step. Owing to the production of the spots, the conventional image forming method is subject to the following drawbacks:

(A) The spots are also recorded on the recording medium to greatly lower the image quality;

(B) The spots make the surface of the photosensitive drum rugged, and the developing agent near the spots cannot thoroughly be removed, lowering the cleaning efficiency;

(C) A cleaning member suffers local abrasion attributed to contact with the spots which make the surface of the photosensitive drum rugged, and therefore shortens its life;

(D) Production of the spots in a short time shortens the replacement cycle for the photosensitive drum; and (E) Frequent checking for the production of the spots and continual removal of the spots are required, thus increasing the maintenance cost.

The spots are produced when the developing agent initially attracted as a nucleus to the surface of the photosensitive drum grows and sticks fast thereto by the repetition of the image forming steps, or when the developing agent penetrates into the photosensitive drum through scratches or other flaws thereon. In any case, the production of the spots would be caused by the pressure or frictional heat which should be applied to the developing agent during the developing, transferring and cleaning steps.

SUMMARY OF THE INVENTION

The present invention is contrived in consideration of these circumstances and is intended to provide an image forming method capable of preventing a developing agent from adhering to the surface of an image carrier in a short period of time by the repetition of image forming steps.

In order to achieve the above object, an image forming method according to the present invention uses a developing agent with a Vickers hardness of 3 or more for image forming steps.

DETAILED DESCRIPTION OF THE PREFERRED EMBODIMENT

A copying machine using one embodiment of an image forming method according to the present invention will now be described in detail with reference to the accompanying drawings.

Figure 1:
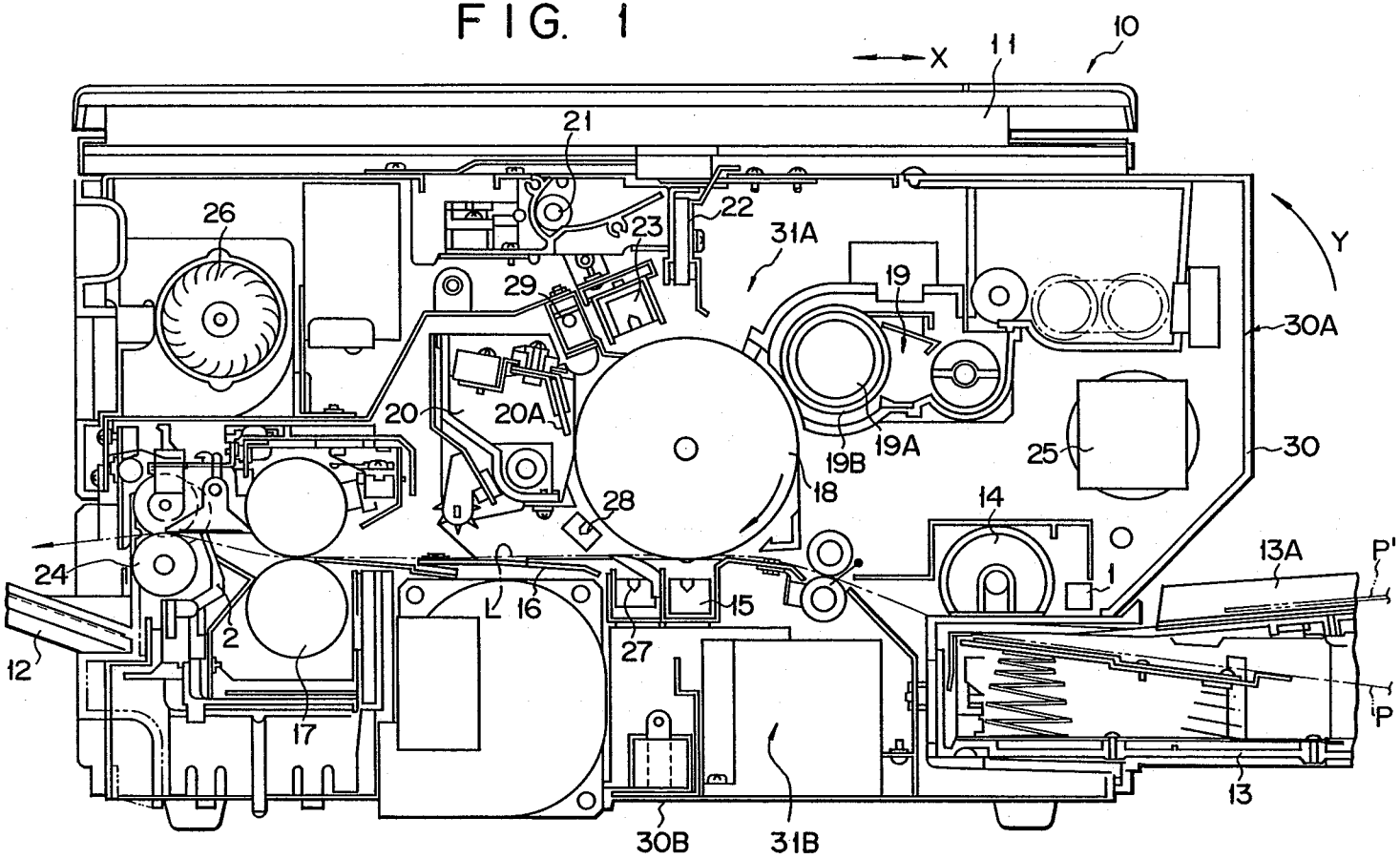
FIG. 1 is a side sectional view schematically showing a copying machine which uses one embodiment of an image forming method according to the present invention.

In FIG. 1, numeral 10 designates a body of the copying machine. An original table 11 to carry an original paper is provided on the top of the body 10. The original table 11 can reciprocate in the direction of arrow X as required. A tray 12 is removably attached to the left-hand side of the body 10. A cassette 13 and a sheet-bypass guide member 13A are removably attached to the right-hand side of the body 10. The cassette 13 contains therein copying sheets P as recording media on which an image is to be recorded, and the sheet-bypass guide member 13A is used in manual paper feed.

The body 10 contains therein a paper feed mechanism 14 for feeding the copying sheets P in the cassette 13 or the sheet-bypass guide member 13A, a transfer mechanism 15 for transferring a developing agent, e.g., toner, to the copying sheets P, a conveyor mechanism 16 for conveying the copying sheets P with the toner transferred thereto, a fixing mechanism 17 for fixing the toner transferred to the copying sheets P, and an image carrier, such as a photosensitive drum 18 with a selenium-tellurium photosensitive layer thereon, on the surface of which is to be formed an electrostatic latent image corresponding to an image. Further arranged in the body 10 are a developing device 19 for electrostatically depositing the toner on the electrostatic latent image on the surface of the photosensitive drum 18 to develop the latent image, a cleaning device 20 for removing the toner remaining on the photosensitive drum 18 after development, a lighting system 21 for lighting up the original paper on the original table 11, a charging device 23 for charging the photosensitive drum 18 before illumination by the lighting system 21, conveyor rollers 24 for discharging the fixed copying sheets P onto the tray 12, and a motor 25 for synchronously operating the photosensitive drum 18.

A cooling device 26 for cooling heat generating parts is set on the left-hand side in the body 10. An empty detector 1 is disposed over the cassette 13, while a jam detector 2 (e.g., microswitch) is on the left of the fixing mechanism 17. In FIG. 1, numerals 27, 28 and 29 designate a sheet separator, a de-electrifier, and a pre-charge exposure lamp, respectively.

A housing 30 of the body 10 is composed of an upper frame 30A and a lower frame 30B. The upper frame 30A is pivotally supported at one end (left-hand end of FIG. 1) on the corresponding end of the lower frame 30B. Thus, the upper frame 30A can be swung up through a desired angle $\theta$ (e.g., 25°) from the lower frame 30B. The upper frame 30A, which is mounted with the photosensitive drum 18, the cleaning device 20, the developing device 19, and the original table 11 by suitable means constitute an upper unit 31A. Likewise, the lower frame 30B, mounted with the cassette 13, the transfer mechanism 15, the fixing mechanism 17, and the tray 12 by suitable means constitute a lower unit 31B. After an operating lever (not shown) is removed from the housing 30 by rocking, the housing 30 can be opened in the direction of arrow Y with the aid of a housing operating device (not shown), exposing a conveying path L for the copying sheets P.

The developing agent used in the copying machine according to this embodiment will now be described. The developing agent is formed of a toner coated with resin which contains a pigment or the like. The surface hardness (Vickers hardness, $H_V$) of the developing agent is set within a range $3 \leqq H_V \leqq 10$. In general, a developing agent may be classified by its magnetic property (magnetic or nonmagnetic) or composition (one- or two-component type). The method of the present invention may be applied to a developing agent of any type, provided it is coated with resin or another material. The adherence of the developing agent to the surface of the photosensitive drum is caused by fusion of the surface of the developing agent or flaws in the surface of the photosensitive drum, which may be caused by the pressure or frictional heat applied to the developing agent during the developing step, cleaning step, etc. Thus, a satisfactory effect may be obtained with use of any developing agent whose surface hardness can be controlled.

Figure 2A:
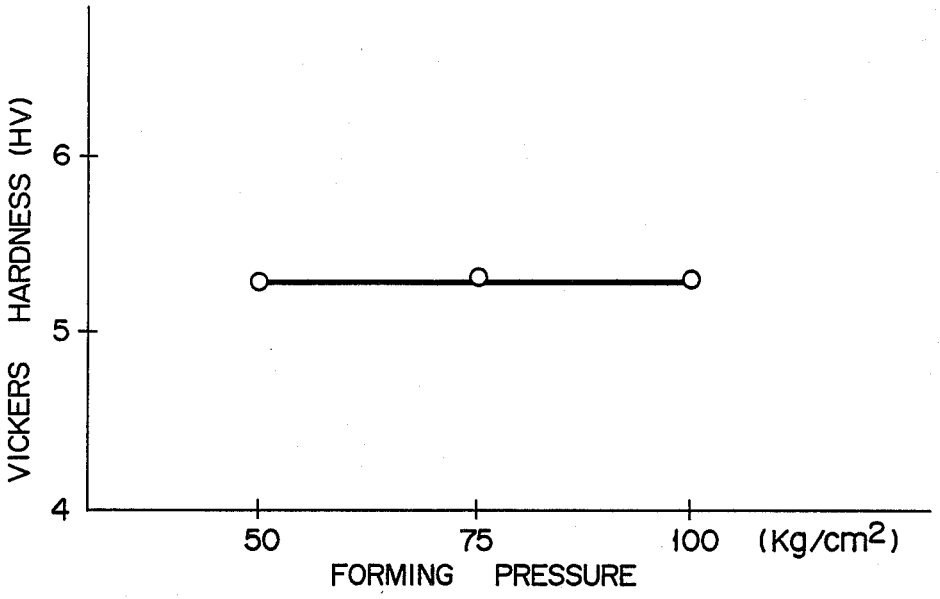
FIG. 2A is a diagram for the measurement of the hardness of a developing agent, showing the relationship between the forming pressure and Vickers hardness.
Figure 2B:
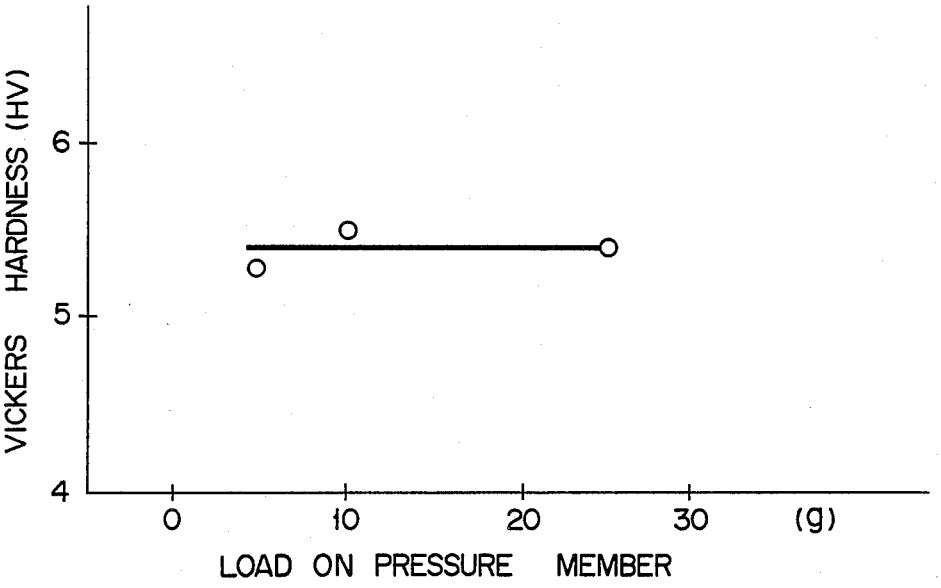
FIG. 2B is a diagram for the measurement of the hardness of the developing agent, showing the relationship between the load on a Vickers pressure member and Vickers hardness.

Measurement of the surface hardness of the developing agent will now be explained. The hardness measurement method is based on the Vickers hardness test method provided by Japanese Industrial Standard Z 2244. Several test pieces were prepared for the measurement. To obtain surfaces approximate to the surface of the actually used developing agent, the test pieces were formed by compacting resins for specified developing agents into cylindrical masses 20 mm in diameter and 2 mm (one-component) in thickness under a load within a predetermined range. The thickness is 4 mm for two-component developing agents. Hardness measurement was conducted on the test pieces for each resin forming each specified developing agent. In the measurement, the relationships between forming pressure (kg/cm$^2$) and Vickers hardness ($H_V$), as shown in FIG. 2A, and between load (g) on Vickers pressure member and Vickers hardness ($H_V$), as shown in FIG. 2B, were determined, and the hardness of each individual test piece was obtained from the average of the measured values.

Developing agents coated with the same resins as the test pieces employed in the hardness measurement were used in the copying machine shown in FIG. 1, and the copying operation was repeated.

A copying operation cycle is performed in the following manner. The original paper on the original table 11 is lit by the lighting system 21, and a reflected light from the original paper is projected through a convergent light transmitting member 22 on the surface of the photosensitive drum 18 to form an electrostatic latent image corresponding to an image of the original paper. Thereafter, the copying sheets P in the cassette 13 or the sheet-bypass guide member 13A are taken out one by one by the paper feed mechanism 14, and guided under the photosensitive drum 18. Meanwhile, the electrostatic latent image is developed into a visible image by the developing agent in the developing device 19. The visible image is transferred to each copying sheet P by the transfer mechanism 15. The copying machine is further provided with a pre-transfer de-electrifier 3 which serves to improve the transfer efficiency and facilitate the separation of the copying sheets P from the photosensitive drum 18. Each copying sheet P is fed by the conveyor mechanism 16 into the fixing mechanism 17, where the transferred image is fixed to the copying sheet P. Thereafter, the copying sheet P is discharged onto the tray 12 through the conveyor rollers 24. The developing agent remaining on the surface of the photosensitive drum 18 after the transfer is removed by the cleaning device 20.

Figure 3:
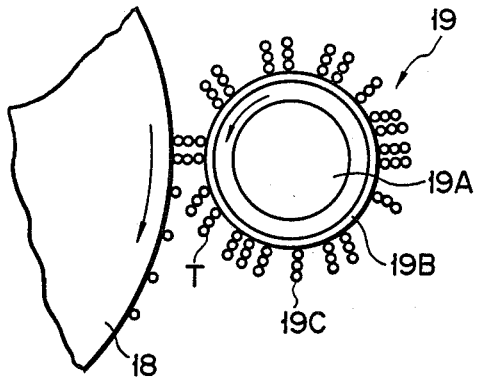
FIG. 3 is a side view schematically showing a developing device.

If the developing device 19 contains therein a magnetic toner as the developing agent, it is provided with a magnet roller 19A and a nonmagnetic sleeve roller 19B fitted on the outer peripheral surface of the magnet roller 19A, as shown in FIG. 3. A magnetic brush 19C composed of the developing agent T is formed on the surface of the sleeve roller 19B. As the magnetic brush 19C touches the photosensitive drum 18, the developing agent T is electrostatically attracted to the electrostatic latent image. Hereupon, a pressure is applied to the developing agent T between the photosensitive drum 18 and the sleeve roller 19B, and frictional heat is generated between the photosensitive drum 18 and the developing agent T.

Figures 4A, 4B, 4C:
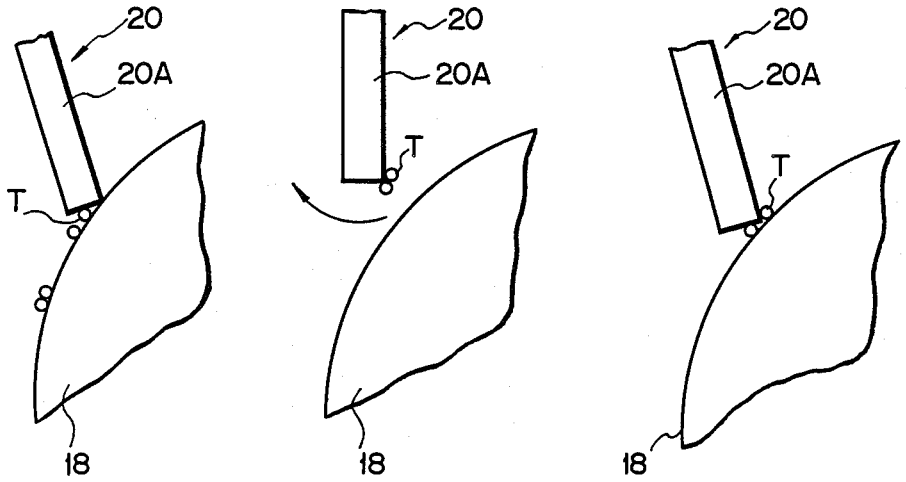
FIGS. 4A to 4C are side views schematically showing a cleaning blade in different operating states.

As shown in FIG. 4A, the cleaning device 20 is provided with a cleaning blade 20A softly contacting the surface of the photosensitive drum 18. The cleaning blade 20A serves to scrape off the remaining developing agent T from the surface of the photosensitive drum 18. At this time, the developing agent T is subjected to pressure and frictional heat between the photosensitive drum 18 and the cleaning blade 20A. After the cleaning process, the cleaning blade 20A is separated from the surface of the photosensitive drum 18, as shown in FIG. 4B. At this time, the developing agent T melted by the pressure and frictional heat is on the tip end of the cleaning blade 20A, and is therefore separated from the photosensitive drum 18. Thereafter, when the cleaning blade 20A is brought into contact with the photosensitive drum 18 for another cleaning cycle, as shown in FIG. 4C, the developing agent T on the tip end of the cleaning blade 20A is subjected to considerable pressure attributable to an impact from the contact. As the copying operation is repeated in this manner, pressure and frictional heat are applied to the developing agent by the developing device 19 and the cleaning device 20.

The copying operation was repeated for five developing agents as test pieces which are different in hardness. The results of the test are tabulated below. The allowable maximum copying frequency is about 100,000 cycles. The Vickers hardness ($H_V$) of the selenium-tellurium photosensitive layer ranges from 30 to 40.

TABLE

| Test Piece No. | 1 | 2 | 3 | 4 | 5 |
|---|---|---|---|---|---|
| Vickers Hardness ($H_V$) | 2.8 | 3.2 | 4.7 | 9.1 | 10.1 |
| Spot | P | A | A | A | A |
| Drum scratch (selenium-coated) | A | A | A | A | P |

Note:
P; Present,
A; Absent

The results of the test indicate that if the Vickers hardness ($H_V$) is 3 or more, the developing agent is prevented from adhering to the surface of the photosensitive drum to form black or colored spots thereon. If the Vickers hardness is less than 3, the surface energy of the developing agent is great. In this case, therefore, the developing agent is partially melted by the pressure and frictional heat applied thereto at the time of cleaning, so that it becomes liable to stick to the surface of the photosensitive drum. Once deposited on the surface of the photosensitive drum, the developing agent forms a nucleus which snowballs. If the Vickers hardness ($H_V$) of the developing agent is 10 or less, no scratch is produced on the surface of the photosensitive drum by the developing agent for the sake of its hardness. If the Vickers hardness is greater than 10, the surface energy of the developing agent is small, so that the developing agent cannot easily stick to the surface of the photosensitive drum. Once deposited, however, the developing agent is caused to penetrate into the surface layer of the photosensitive drum to damage the same by the pressure applied in the cleaning and developing steps. If the developing agents penetrates deeper into the photosensitive drum and is set therein, it forms a nucleus to produce spots.

Thus, in the embodiment described above, the Vickers hardness of the developing agent used ranges from 3 to 10, both inclusive, so that no spots or scratches are produced on the surface of the photosensitive drum.

It is to be understood that the present invention is not limited to the above embodiment, and that various changes and modifications may be effected therein by one skilled in the art without departing from the scope or spirit of the invention. In the above embodiment, for example, selenium-tellurium material is used for the photosensitive layer, so that the allowable maximum hardness of the developing agent used is 10. This maximum value is correlative to the surface hardness of the photosensitive drum (30 to 40 for selenium-tellurium photosensitive drum). Therefore, the surface hardness of the photosensitive drum can suitably be determined by its material (e.g., amorphous silicon). For example, the Vickers hardness of a selenium-arsenic photosensitive layer ranges from 100 to 150, while that of a developing agent suitable for use with such a photosensitive layer ranges from 3 to 50. On the other hand, the Vickers hardness of an amorphous silicon photosensitive layer ranges from 1,000 to 1,500, while that of a developing agent suitable for use with such a photosensitive layer ranges from 3 to 500.

If the developing agent used in a copying machine is intended for pressure fixation and has its hardness within the aforesaid range, the copying machine may be provided with a fixing mechanism which uses a fixing process other than the pressure fixing method. Thus, the developing agent may enjoy versatility.

In the image forming method according to the present invention, as seen from the above description, a developing agent with a Vickers hardness of 3 or more is used for image forming steps, so that the developing agent may be prevented from being caused to adhere to the surface of an image carrier in a short period of time by the repetition of the image forming steps, and that various other drawbacks of the prior art method can be eliminated.

What is claimed is:

1. An image forming method comprising:

a first step for forming a latent image on an image carrier in accordance with an image, said image carrier including a photoconductive layer mainly composed of selenium-tellurium;

a second step for supplying a developing agent with a vickers hardness ranging from 3 to 10, both inclusive, thereby developing the latent image into a visible image, said Vickers hardness of the developing agent being correlated to the Vickers hardness of the photoconductive layer ranging from 30 to 40;

a third step for transferring the visible image to the surface of a recording medium; and a fourth step for removing the developing agent remaining on the image carrier after the third step, by temporarily contacting a cleaning blade onto the image carrier.

2. The method according to claim 1, further comprising a fifth step for fixing the visible image transferred to the surface of the recording medium, said fifth step following the third step.

3. The method according to claim 2, wherein said developing agent is fixed to the surface of the recording medium by being subjected to a pressure, and pressure-fixing is executed in said fifth step.

4. The method according to claim 3, wherein said fifth step includes fixing the visible image to the recording medium in a manner such that the recording medium with the visible image transferred thereto is held between two rollers.

5. An image forming method comprising:

a first step for forming a latent image on an image carrier in accordance with an image, said image carrier including a photoconductive layer mainly composed of amorphous silicon;

a second step for supplying a developing agent with a Vickers hardness ranging from 3 to 500, both inclusive, thereby developing the latent image into a visible image, said Vickers hardness of the developing agent being correlated to the Vickers hardness of the photoconductive layer ranging from 1000 to 1500;

a third step for transferring the visible image to the surface of the recording medium; and a fourth step for removing the developing agent remaining on the image carrier after the third step, by temporarily contacting a cleaning blade onto the image carrier.

6. The method according to claim 5, futher comprising a fifth step for fixing the visible image transferred to the surface of the recording medium, said fifth step following the third step.

7. The method according to claim 6, wherein said developing agent is fixed to the surface of the recording medium by being subjected to a pressure, and pressure-fixing is executed in said fifth step.

8. The method according to claim 7, wherein said fifth step includes fixing the visible image to the recording medium in a manner such that the recording medium with the visible image transferred thereto is held between two rollers.

9. An image forming method comprising:

a first step for forming a latent image on image carrier in accordance with an image, said image carrier including a photoconductive layer mainly composed of selenium-arsenic;

a second step for supplying a developing agent with a Vickers hardness ranging from 3 to 50, both inclusive, thereby developing the latent image into a visible image, said Vickers hardness of the developing agent being correlated to the Vickers hardness of the photoconductive layer ranging from 100 to 150;

a third step for transferring the visible image to the surface of the recording medium; and a fourth step for removing the developing agent remaining on the image carrier after the third step, by temporarily contacting a cleaning blade onto the image carrier.

10. The method according to claim 9, further comprising a firth step for fixing the visible image transferred to the surface of the recording medium, said fifth step following the third step.

11. The method according to claim 10, wherein said developing agent is fixed to the surface of the recording medium by being subjected to a pressure, and pressure-fixing is executed in said fifth step.

12. The method according to claim 11, wherein said fifth step includes fixing the visible image to the recording medium in a manner such that the recording medium with the visible image transferred thereto is held between two rollers.

13. An image forming method comprising:

a first step for forming a latent image on an image carrier in accordance with an image, said image carrier including a photoconductive layer mainly composed of selenium-tellurium;

a second step for supplying a developing agent with a Vickers hardness ranging from 3 to 10, both inclusive, by touching a magnetic brush onto the image carrier, thereby developing the latent image into a visible image;

a third step for transferring the visible image to the surface of a recording medium;

a fourth step for pressure-fixing the visible image transferred to the surface of the recording medium, following the third step; and a fifth step for removing the developing agent remaining on the image carrier after the fourth step.

14. The method according to claim 13 wherein said fourth step includes fixing the visible image to the recording medium in a manner such that the recording medium with the visible image transferred thereto is held between two rollers.

15. An image forming method comprising:

a first step for forming a latent image on an image carrier in accordance with an image, said image carrier including a photoconductive layer mainly composed of amorphous silicon;

a second step for supplying a developing agent with a Vickers hardness ranging from 3 to 500, both inclusive, by touching a magnetic brush onto the image carrier, thereby developing the latent image into a visible image;

a third step for transferring the visible image to the surface of a recording medium;

a fourth step for pressure-fixing the visible image transferred to the surface of the recording medium, following the third step; and a fifth step for removing the developing agent remaining on the image carrier after the fourth step.

16. The method according to claim 15, wherein said fourth step includes fixing the visible image to the recording medium in a manner such that the recording medium with the visible image transferred thereto is held between two rollers.

17. The method according to claim 15, wherein said photoconductive layer has a Vickers hardness ranging from 1000 to 1500.

18. An image forming method comprising:

a first step for forming a latent image on image carrier in accordance with an image, said image carrier including a photoconductive layer mainly composed of selenium-arsenic;

a second step for supplying a developing agent with a Vickers hardness ranging from 3 to 50, both inclusive, by touching a magnetic brush onto the image carrier, thereby developing the latent image into a visible image;

a third step for transferring the visible image to the surface of the recording medium;

a fourth step for pressure-fixing the visible image transferred to the surface of the recording medium, following the third step; and a fifth step for removing the developing agent remaining on the image carrier after the fourth step.

19. The method according to claim 18, wherein said fourth step includes fixing the visible image to the recording medium in a manner such that the recording medium with the visible image transferred thereto is held between two rollers.

20. The method according to claim 18, wherein said photoconductive layer has a Vickers hardness ranging from 100 to 150.

21. The method according to claim 13 wherein said photoconductive layer has a Vickers hardness ranging from 30 to 40.

* * * * *